US006883289B2

(12) United States Patent
Juedes et al.

(10) Patent No.: US 6,883,289 B2
(45) Date of Patent: Apr. 26, 2005

(54) APPARATUS AND METHOD FOR REINFORCING CONCRETE USING REBAR SUPPORTS

(76) Inventors: Brian M. Juedes, 13644 E. Paradise Dr., Scottsdale, AZ (US) 85259; Bryan D. Toone, 1088 N. Portland Ave., Gilbert, AZ (US) 85233; Erik Meeker, 7001 Tafford Dr., Anchorage, AK (US) 99504

( * ) Notice: Subject to any disclaimer, the term of this patent is extended or adjusted under 35 U.S.C. 154(b) by 0 days.

(21) Appl. No.: 10/447,834

(22) Filed: May 28, 2003

(65) Prior Publication Data

US 2004/0099785 A1 May 27, 2004

Related U.S. Application Data

(60) Provisional application No. 60/428,482, filed on Nov. 22, 2002.

(51) Int. Cl.[7] ..... E04C 5/16; E01C 11/18
(52) U.S. Cl. ..... 52/687; 404/135
(58) Field of Search ..... 52/677, 682, 685, 52/686, 687, 688, 689; 404/134, 135; 249/34, 207

(56) References Cited

U.S. PATENT DOCUMENTS

| | | | | | |
|---|---|---|---|---|---|
| 972,961 | A | * | 10/1910 | Wedmoree | 52/689 |
| 1,268,887 | A | * | 6/1918 | Schroeder | 52/687 |
| 1,613,351 | A | * | 1/1927 | Klinger et al. | 404/135 |
| 1,882,499 | A | * | 10/1932 | Stinson | 52/454 |
| 3,673,753 | A | * | 7/1972 | Anderson | 52/685 |
| 3,693,310 | A | * | 9/1972 | Middleton | 52/685 |
| 4,644,727 | A | * | 2/1987 | Hanson et al. | 52/687 |
| 4,726,560 | A | | 2/1988 | Dotson | |
| 5,555,693 | A | | 9/1996 | Sorkin | |
| 5,592,785 | A | * | 1/1997 | Gavin | 52/20 |
| 5,664,390 | A | | 9/1997 | Sorkin | |
| 5,762,300 | A | | 6/1998 | Sorkin | |
| 5,826,387 | A | | 10/1998 | Henderson et al. | |
| 5,937,604 | A | * | 8/1999 | Bowron | 52/426 |
| 6,108,910 | A | | 8/2000 | Sorkin | |
| 6,119,526 | A | | 9/2000 | Reigstad et al. | |
| 6,120,723 | A | | 9/2000 | Butler | |
| 6,435,765 | B1 | | 8/2002 | Crane et al. | |
| 6,571,526 | B1 | * | 6/2003 | Queen | 52/677 |

* cited by examiner

*Primary Examiner*—Michael Safavi
(74) *Attorney, Agent, or Firm*—Mark F. Wright; Wright Law Group PLLC

(57) ABSTRACT

The present invention provides an apparatus and method for suspending and positioning structural reinforcement elements such as rebar within a framework for a slab-on-grade foundation or other type of concrete structure. Each rebar support of the present invention comprises a plurality of rebar support arms that, in concert with the other components of the foundation or concrete structure, supports one or more pieces of rebar in a desired orientation.

16 Claims, 3 Drawing Sheets

APPARATUS AND METHOD FOR REINFORCING CONCRETE USING REBAR SUPPORTS

This application claims the benefit of U.S. Provisional application No. 60/428,482, filed on Nov. 22, 2002.

BACKGROUND OF THE INVENTION

1. Technical Field

The present invention relates to suspending and positioning metal reinforcing bars (rebar) in the footings and foundations of buildings and other structures.

2. Background Art

Pre-stressed concrete is a type of reinforced concrete that has been subjected to an external compressive force prior to the application of loads. Typical applications for pre-stressed concrete include slab-on-grade construction and the like. The compressive force in the concrete slab is typically provided by placing steel tendons within the concrete that are initially tensioned with hydraulic jacks and held in tension by end anchors secured to the foundation forms.

Pre-stressed concrete may be broadly categorized as either pre-tension or post-tension. Pre-tension refers to the method of first stressing tendons and then casting concrete around the pre-stressed tendons. The concrete cures before releasing the pre-stressed tendons and transferring the stress from the tendons to the concrete. Post-tension refers to the method of casting concrete around unstressed tendons and then stressing the tendons after the concrete has reached a specified strength.

Although the modern method of pre-stressing concrete may be traced to the late 1920's, its general use in the United States did not begin until the late 1940's or early 1950's. General acceptance and the primary increase in use occurred primarily between 1965 and 1975. Application of pre-stressing was being made in all aspects of construction including buildings, towers, floating terminals, ocean structures and ships, storage tanks, nuclear containment vessels, bridge piers, bridge decks, foundations, soil anchors, and virtually all other types of installations where normal reinforced concrete was acceptable. Thus, pre-stressed concrete and methods for its initial installation for diverse applications is now well known.

Similarly, the use of rebar in reinforced concrete structures, and in particular, concrete structures in which the reinforcing steel has a connection with surrounding earth, is well known. The typical application usually involves the placement of rebar in the footings or foundations utilized in homes, commercial buildings, or other concrete structures. The long time practice for utilizing rebar in the construction of the footing or other foundational support system for building and the like is to dig a trench in the ground and, in order to impart tensile strength to the concrete which will fill the trench and constitute the footing, suspend one or more horizontally-positioned layers of steel reinforcing bars within the trench. Additionally, rebar is used in foundation slabs and as a reinforcing means for other parts of the foundation, particularly for transferring loads from areas of lower stability to areas of higher stability.

One common practice for placing rebar in footings and foundations is to suspend or otherwise position the rebar at the proper location and orientation using pieces of wire wrapped around nails, rebar stakes and other rebar sections. In most cases, it is desirable to utilize sufficient rebar and wire to provide the necessary strength to hold the various rebar reinforcing materials in place against the force of the concrete as it is poured around the rebar to form the footings and/or foundation for the structure. This is especially the case with pre-stressed concrete where the rebar and tendons act in concert to strengthen and reinforce the concrete structure.

Although the above-mentioned practices are relatively simple to implement and generally well accepted in the construction industry, they are not without certain limitations. One of the most significant issues is the amount of time and energy that is required to suspend the rebar in place using concrete forms, nail, tie wire, etc. Since the placement of the rebar is generally a manual process, it can be very time-consuming to place and tie each section of rebar in place. Additionally, the use of wire to tie the rebar in place can provide for less than optimal stability.

In some cases, the wire is not tied securely and the weight of the concrete being poured over the rebar can cause the rebar to be dislodged and shifted out of position. Alternatively, the rebar may shift or rotate in place, further destabilizing the entire rebar support system. Finally, there may be a certain lack of uniformity and deviation from best practices in the suspension of the rebar, based on the diligence and experience of the workers suspending the rebar in place. If any of this happens, the structural integrity of the concrete foundation or structure can be comprised. Any such undesirable movement of the rebar requires an even more time-consuming operation to retrieve or remove the dislocated rebar and replace/reposition it in the desired and proper location.

Accordingly, without an improved rebar support apparatus that can properly suspend, support and position the rebar in the appropriate location and orientation, while simultaneously providing an inexpensive, quick and easy installation process that fixes the rebar firmly in place and maintains the requisite stability for the suspended rebar, the structural effectiveness associated with the placement of rebar in concrete footings and foundations will continue to be sub-optimal.

BRIEF SUMMARY OF THE INVENTION

The present invention provides an apparatus and method for suspending and positioning structural reinforcement elements such as rebar within a framework for a slab-on-grade foundation or other type of concrete structure. Each rebar support of the present invention comprises a plurality of rebar support arms that, in concert with the other components of the foundation or concrete structure, supports one or more pieces of rebar in a desired orientation.

BRIEF DESCRIPTION OF THE DRAWINGS

The preferred embodiments of the present invention will hereinafter be described in conjunction with the appended drawings, wherein like designations denote like elements, and.

DETAILED DESCRIPTION OF THE PREFERRED EMBODIMENTS

Figure 1:
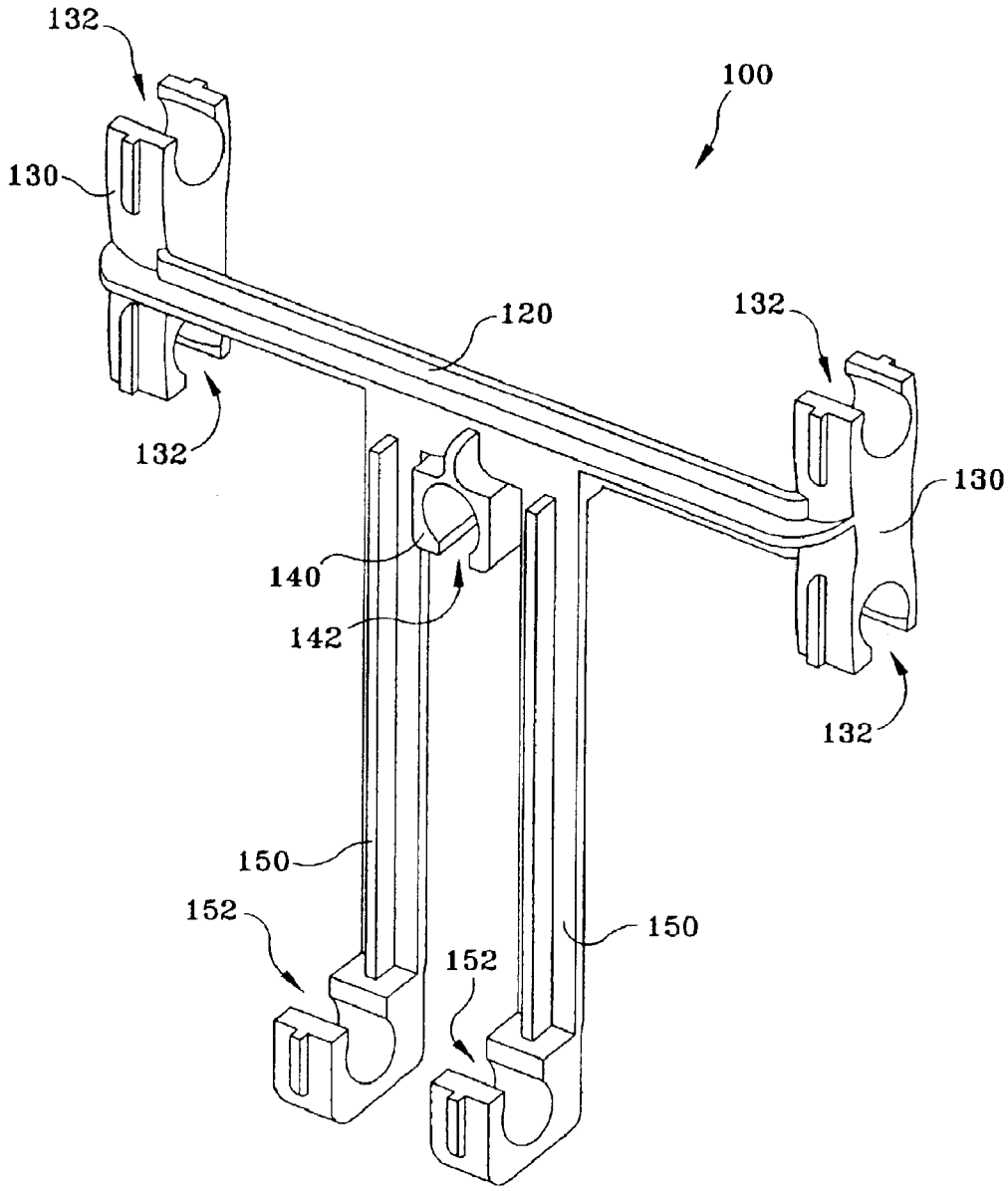
FIG. 1 is a perspective view of a rebar support according to a preferred exemplary embodiment of the present invention.

Referring now to FIG. 1, a rebar support 100 according to the most preferred embodiment of the present invention is shown. Rebar support 100 comprises: a horizontal portion 120; a pair of rebar support arms 130; a tendon support portion 140; and a pair of vertical support stabilizers 150. Rebar support arms 130 are configured to receive one or more lengths of rebar and securely hold the rebar in a desired position.

Each rebar support arm 130 is coupled to horizontal portion 120 and comprises at least one rebar-receiving portion 132 and each rebar-receiving portion 132 is sized and configured to receive a piece of rebar. The exact size of rebar-receiving portions 132 will be determined based on the specific application. Those skilled in the art will recognize that many different sizes are available for use and rebar-receiving portion 132 can be sized accordingly. While it is possible to create a rebar support 100 with a single support arm 130 and/or a single vertical support stabilizer 150, these embodiments are less preferred because they lack the stability inherent in rebar support 100 as represented in FIG. 1.

Tendon support portion 140 is coupled to horizontal portion 120 and further comprises a tendon-receiving portion 142. Tendon-receiving portion 142 is sized and configured to receive a support tendon or other part of the structural support system for a slab-on-grade or similar concrete structure. In a typical application, one or more rebar supports 100 are positioned over a support tendon or other similar support member and pressed down, thereby engaging a support tendon in tendon-receiving portion 142 and coupling or tethering rebar support 100 to a support tendon. In a similar fashion, additional rebar supports can be positioned on multiple support tendons. It should be noted that in the most typical applications, the support tendons are physically located in a plane that is substantially perpendicular to the plane defined by the rebar sections positioned in support arms 130.

In the most preferred embodiments of the present invention, vertical support stabilizers 150 are substantially parallel to each other and descend vertically from horizontal portion 120. Each vertical support stabilizer 150 comprises a rebar-receiving portion 152 that is sized and configured to receive a section of rebar. In a typical application, rebar-receiving portion 152 will be coupled to a foundation support rebar Rebar support 100 is most preferably manufactured in a single, unitary piece from a durable, resilient non-metallic material such as plastic. This can be accomplished by any of the techniques and practices known to those skilled in the art, including the various mold processes used to manufacture most relatively small plastic items.

While rebar support 100 is most preferably manufactured from plastic or some similar material, it is important that the material not be overly hard or brittle. There should be some "give" to the material so that rebar-receiving portions 132 and tendon-receiving portion 142 can "flex" without breaking. This will allow rebar receiving portion 132 and tendon-receiving portion 142 to respectively accept rebar sections and tendons without breaking and will allow rebar support 100 to withstand the various forces to which it is subjected during the concrete pouring operation without cracking.

This specific embodiment of the present invention is particularly well suited for positioning "hairpin" rebar supports. Those skilled in the art will understand that a hairpin rebar support is typically fashioned from a short piece of rebar, approximately 3–5 feet in length, that is doubled back on itself to form a substantially U-shaped rebar support. Each arm of the hairpin rebar support can be securely fixed in place by utilizing upper and lower rebar-receiving portions 132 of rebar support arm 130. Further explanation of this feature is presented in conjunction with the discussion of FIG. 2.

Figure 2:
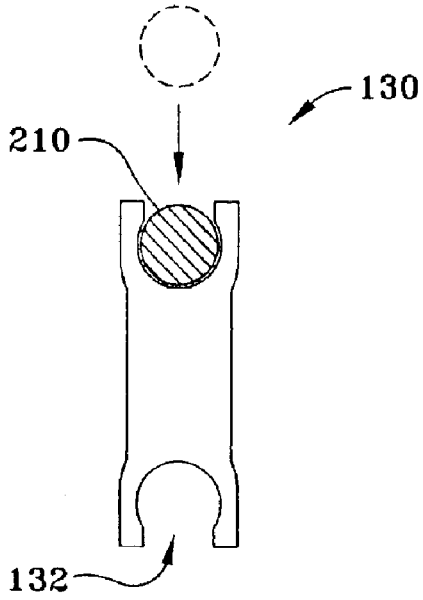
FIG. 2 is a side view of the rebar support of FIG. 1, showing a piece of rebar being inserted into a rebar support in accordance with a preferred exemplary embodiment of the present invention.

Referring now to FIG. 2, a side view of a rebar support arm 130 of FIG. 1 is shown. In the most preferred embodiments of the present invention, rebar support arms 130 are manufactured from a durable, resilient, hard plastic material. While the plastic material selected must be relatively hard, a brittle plastic may not withstand the weight and pressure of the concrete pouring in place and may shatter. As shown in FIG. 2, each rebar support arm 130 has an upper and lower rebar-receiving portion 132. A section of rebar 210 can be coupled to rebar support arm 130 by pressing or urging rebar 210 into the opening defined by rebar-receiving portion 132. The pressure exerted on rebar 210 may be downward or upward directed, as required.

Rebar support arm 122 is preferably formed as an integral part of rebar support 100 at the time of manufacture and further comprises a rebar-receiving portion 132. Rebar-receiving portion 132 is an opening in rebar support arm 130 that slightly restricts and constrains a piece of rebar 210 when rebar 210 is inserted into rebar-receiving portion 132. As shown in FIG. 2, rebar 210 may be inserted into rebar support arm 130 by applying pressure and forcing rebar 210 into rebar-receiving portion 132.

Rebar-receiving portion 132 marginally resists the entry of rebar 210 because the opening defined by rebar-receiving portion 132 is slightly smaller than the diameter of rebar 210. However, since rebar-receiving portion 132 is made from a resilient and slightly flexible material, rebar-receiving portion 132 will flex wide enough to receive rebar 210 if enough pressure is applied to rebar 210. After rebar 210 has been inserted, rebar-receiving portion 132 will "snap" back into its original shape, thereby "locking" or holding rebar 210 in position within rebar-receiving portion 132. It should be noted that rebar-receiving portions 152 associated with vertical support stabilizers 150 and tendon-receiving portion 142 of tendon support portion 140 function in substantially the same fashion to receive a section of rebar or a tendon.

Figure 3:
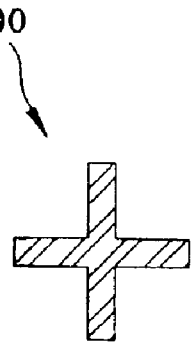
FIG. 3 is a cross-sectional view of certain portions of a rebar support in accordance with a preferred exemplary embodiment of the present invention.

Referring now to FIG. 3, a cross-sectional portion 300 representing a cross section for certain portions of rebar support 100 of FIG. 1 is shown. As seen in FIG. 3, the cross-sectional view is substantially cruciate or cross-shaped in nature. In the most preferred embodiments of the present invention, horizontal portion 120, and vertical support stabilizers 150 each exhibit the cruciate form of cross-sectional portion 300. Cruciate cross section 300 has been selected to minimize the amount of material used to fabricate rebar support 100 while maximizing the structural stability of rebar support 100. Those skilled in the art will recognize that other cross-sectional choices are possible and perhaps desirable, based on the specific application for a given rebar support 100.

Figure 4:
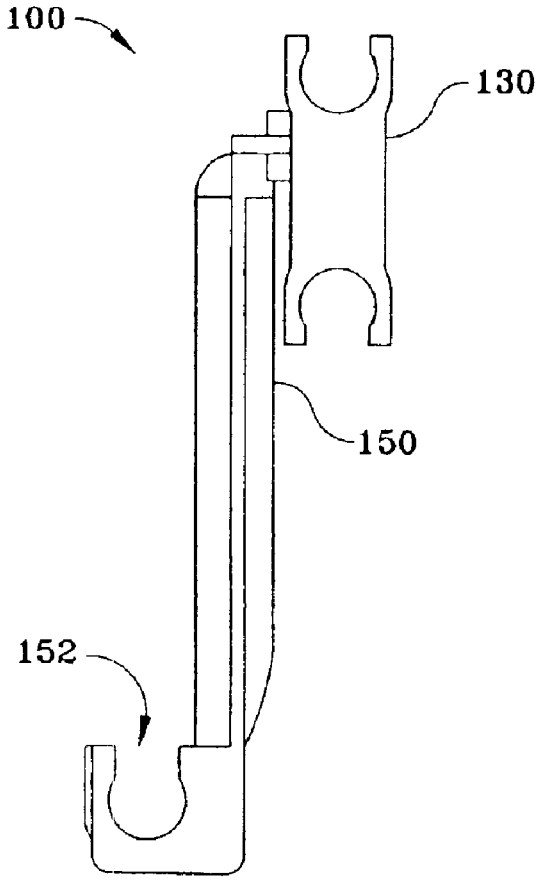
FIG. 4 is a side view of a rebar support in accordance with a preferred exemplary embodiment of the present invention.

Referring now to FIG. 4, a side view of rebar support 100 from FIG. 1 is depicted. As shown in FIG. 4, rebar support arms 130 are offset from vertical support stabilizers 150. With this configuration, the rebar sections placed into rebar-receiving portions 132 are not physically located in the same vertical plane as the rebar sections placed into rebar-receiving portions 152. Additionally, tendon-receiving portion 140 (not visible this FIG.) is physically located in a different vertical plane than the plane defined by the rebar sections placed into rebar-receiving portions 132 and the rebar sections placed into rebar-receiving portions 152. The practical implication of this multi-planar arrangement allows tendon-receiving portion 140 to be located at a more advantageous position on a given support tendon without displacing the rebar sections placed into rebar-receiving portions 132 and the rebar sections placed into rebar-receiving portions 152.

Figure 5:
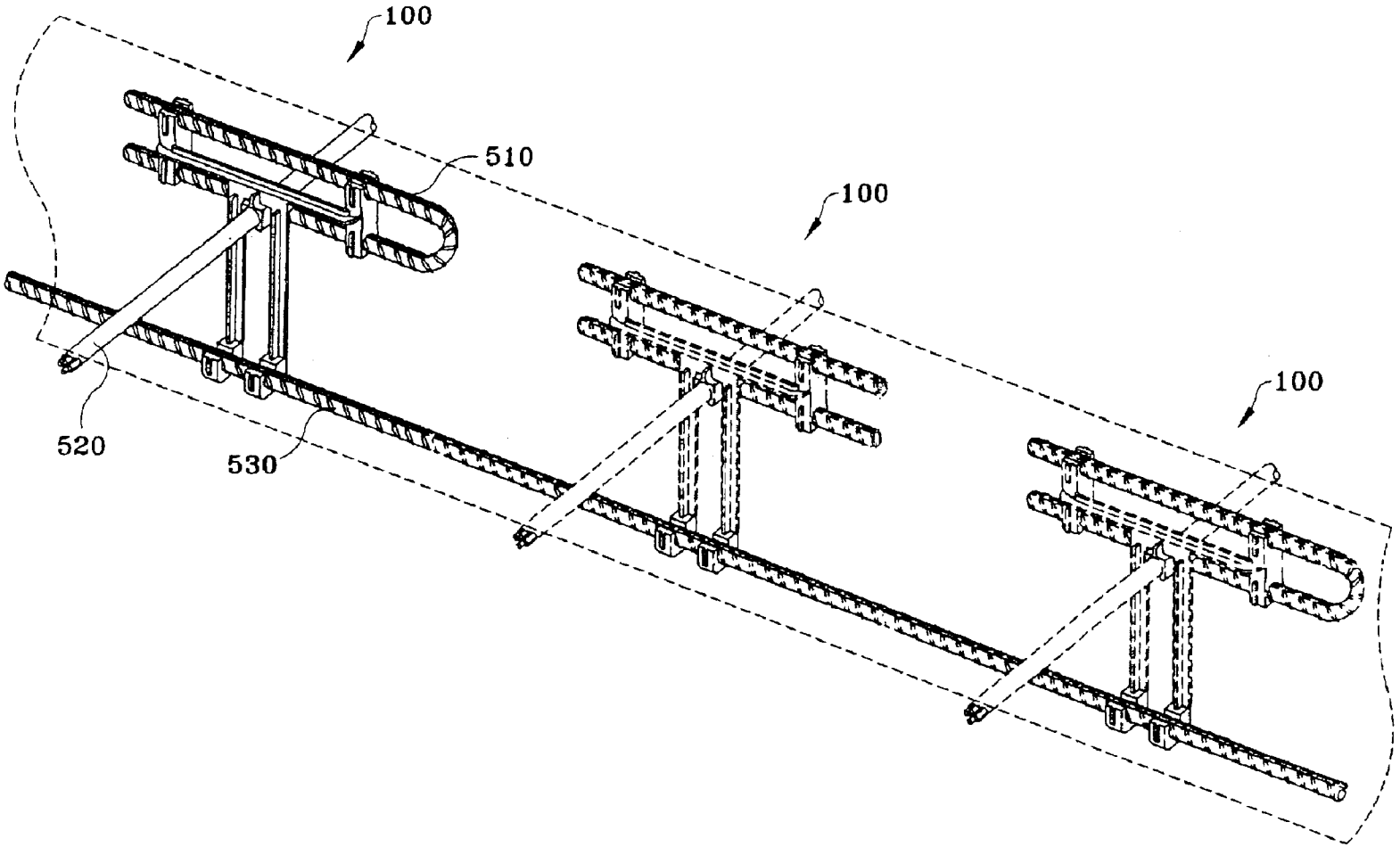
FIG. 5 is a perspective view of a typical application using a plurality of rebar supports in accordance with a preferred exemplary embodiment of the present invention.

Referring now to FIG. 5, a perspective view of a typical application using rebar supports 100 is shown. As shown in FIG. 5, a plurality of hairpin rebar supports 510 are each coupled to a rebar support 100 and each rebar support 100 holds each hairpin rebar support in a desired position. Each rebar support 100 is positioned in place and is supported by a tendon 520. Additionally, each rebar support is coupled to a continuous foundation rebar support 530 as previously described in conjunction with FIG. 1. Although only three rebar supports 100 are shown, in a typical application, dozens or even hundreds of rebar supports 100 may be utilized in a given application.

In this fashion, multiple hairpin rebar supports 510 are suspended such that they occupy space in substantially the same vertical plane. It should be noted that tendons 520 are substantially co-planar with each other and that the horizontal plane defined by tendons 520 is substantially perpendicular to the vertical plane defined by hairpin rebar supports 510. Finally, it should also be noted that for the most preferred embodiments of the present invention, the vertical plane defined by foundation rebar support 530 is offset from and substantially parallel to the plane defined by hairpin rebar supports 510.

As shown in FIG. 5, each hairpin rebar support 510 is held firmly in place by four different coupling points, i.e., each of four rebar-receiving portions for each rebar support 100. Similarly, each rebar support 100 is held firmly in place by being coupled to foundation rebar support 530 in two different places while also being coupled to and secured by a support tendon 520. This physical inter-coupling of the various rebar sections, support tendons, and rebar supports 100 provides a secure and stable framework for a slab-on-grade foundation. Rebar supports 100 act as an intermediary coupling mechanism between foundation rebar support 530 and hairpin rebar supports 510. The exact number and placement of rebar supports 100 will be determined by the specific application. Additionally, although the present invention has been illustrated in the context of a slab-on-grade foundation, other applications will be apparent to those skilled in the art. Finally, although the present invention has been illustrated using hairpin rebar supports, other configurations may be utilized. For example, two discrete rebar sections may be used, with one rebar section being placed in the upper rebar support arms and another rebar section being placed in the lower rebar support arms.

In summary, the most preferred embodiments of the rebar support of the present invention are used in concert with existing foundation framework members to firmly and securely position various rebar supports in place and couple the various components together, thereby ensuring stable and secure rebar reinforcement for a concrete foundation. In addition, the use of rebar supports to hold rebar supports in place allows a worker to quickly and easily place rebar in position within a foundation or footing trench by dispensing with the traditional use of tie wires. This is especially important in applications where multiple pieces of rebar are being deployed because substantial times savings can be realized when the labor-intensive effort of tying each individual piece of rebar in place is circumvented.

From the foregoing description, it should be appreciated that apparatus and methods for providing introduction for the purpose of meeting is provided and presents significant benefits that would be apparent to one skilled in the art. Furthermore, while multiple embodiments have been presented in the foregoing description, it should be appreciated that a vast number of variations in the embodiments exist. Lastly, it should be appreciated that these embodiments are preferred exemplary embodiments only, and are not intended to limit the scope, applicability, or configuration of the invention in any way. Rather, the foregoing detailed description provides those skilled in the art with a convenient road map for implementing a preferred exemplary embodiment of the invention, it being understood that various changes may be made in the function and arrangement of elements described in the exemplary preferred embodiment without departing from the spirit and scope of the invention as set forth in the appended claims.

What is claimed is:

1. A rebar support comprising:

a horizontal portion;

a first rebar support arm coupled to said horizontal portion, said first rebar support arm being configured to receive a first length of rebar in a first orientation;

a second rebar support arm coupled to said horizontal portion, said second rebar support arm being configured to receive a second length of rebar in a second orientation, said second orientation being substantially parallel to said first orientation;

a first vertical support stabilizer coupled to said horizontal portion, said first vertical support stabilizer being configured to receive a third length of rebar in a third orientation, said third orientation being substantially parallel to said first orientation and said second orientation;

a second vertical support stabilizer coupled to said horizontal portion, said second vertical support stabilizer being configured to receive a fourth length of rebar in a fourth orientation, said fourth orientation being substantially parallel to said first orientation and said second orientation and said third orientation; and a tendon-receiving portion coupled to said horizontal portion, said tendon-receiving portion bring configured to receive and position a support tendon in a fifth orientation in a vertical space beneath said first and second lengths of rebar and above said third and fourth lengths of rebar, said fifth orientation being substantially perpendicular to said first orientation and said second orientation and said third orientation and said fourth orientation, said tendon-receiving portion being configured to isolate said tendon from said first length of rebar and said second length of rebar and said third length of rebar and said fourth length of rebar.

2. The rebar support of claim 1 further comprising:

said first length of rebar positioned in said first rebar support arm;

said second length of rebar positioned in said second rebar support arm;

said third length of rebar positioned in said first vertical support stabilizer; and said fourth length of rebar positioned in said second vertical support stabilizer.

3. The rebar support of claim 2 wherein said first length of rebar and said second length of rebar comprise a first portion and a second portion of a unitary hairpin rebar.

4. The rebar support of claim 2 wherein said third length of rebar and said fourth length of rebar comprise a first portion and a second portion of a unitary piece of rebar.

5. The rebar support of claim 2 further comprising a tendon receiving portion, said tendon receiving portion being coupled to said horizontal portion and being positioned between said first vertical support stabilizer and said second vertical support stabilizer.

6. The rebar support of claim 5 wherein:

said tendon receiving portion is positioned between said first vertical support stabilizer and said second vertical support stabilizer.

7. The rebar support of claim 2 wherein said horizontal portion and said first and second vertical support stabilizers each exhibit a cross-section that is substantially cruciate in nature.

8. The rebar support of claim 2 wherein said rebar support is enclosed within a concrete slab-on-grade foundation.

9. A method comprising the steps of:

inserting a tendon into a tendon-receiving portion of a rebar support, said rebar support comprising:

a horizontal portion;

at least one rebar support arm coupled to said horizontal portion, said at least one rebar support arm being configured to receive a first length of rebar; and a least one vertical support stabilizer coupled to said horizontal portion, said at least one vertical support stabilizer being configured to receive a second length of rebar; and inserting said first length of rebar into said at least one rebar support arm, said first length of rebar being substantially perpendicular to said tendon, said at least one rebar support arm isolating said first length of rebar from said tendon, said rebar support arm positioning said first length of rebar in a first vertical space above said tendon;

inserting said second length of rebar into said at least one vertical support stabilizer, said second length of rebar being substantially perpendicular to said tendon, said second length of rebar, said vertical support stabilizer isolating said second length of rebar from said tendon, said at least one vertical support stabilizer positioning said second length of rebar in a second vertical space beneath said tendon.

10. The method of claim 9 wherein said step of inserting said a first length of rebar into said at least one rebar support arm comprises the step of exerting a downward pressure on said first length of rebar, thereby urging said first length of rebar into said at least one rebar support arm.

11. A method of suspending rebar in a desired position, prior to pouring a concrete slab-on-grade foundation comprising the steps of:

a) inserting a tendon into a tendon-receiving portion of a rebar support, thereby suspending said rebar support in place, said rebar support comprising:

a horizontal portion;

a first rebar support arm coupled to said horizontal portion, said first rebar support arm being configured to receive a first length of rebar;

a second rebar support arm coupled to said horizontal portion, said second rebar support arm being configured to receive a second length of rebar;

a first vertical support stabilizer coupled to said horizontal portion, said first vertical support stabilizer being configured to receive a first portion of a third length of rebar;

a second vertical support stabilizer coupled to said horizontal portion, said second vertical support stabilizer being configured to receive a second portion of said third length of rebar; and b) inserting said first length of rebar into said first rebar support arm;

c) inserting said second length of rebar into said second rebar support arm;

d) inserting said third length of rebar into said first and second vertical support stabilizers.

12. The method of claim 11 wherein said first length of rebar and said second length of rebar comprise a first portion and a second portion of a unitary hairpin rebar.

13. The method of claim 12 further comprising the steps of repeating steps a–d for a plurality of rebar supports and a plurality of lengths of rebar.

14. The method of claim 11 further comprising the step of pouring concrete over said tendon and said rebar support and said first, second, and third lengths of rebar, thereby encasing said tendon and said rebar support and said first, second, and third lengths of rebar in a slab-on-grade foundation.

15. The method of claim 13 further comprising the step of pouring concrete over said plurality of rebar supports and said plurality of lengths of rebar, thereby encasing said plurality of rebar supports and said plurality of lengths of rebar in a slab-on-grade foundation.

16. The method of claim 11 wherein:

said step of inserting said first length of rebar into said first rebar support arm comprises the step of exerting a downward pressure on said first length of rebar, thereby urging said first length of rebar into said first rebar support arm;

said step of inserting said second length of rebar into said second rebar support arm comprises the step of exerting a upward pressure on said second length of rebar, thereby urging said second length of rebar into said second rebar support arm; and said step of inserting said third length of rebar into said first and second vertical support stabilizers comprises the step of exerting a downward pressure on said third length of rebar thereby urging said third length of rebar into said first and second vertical support stabilizers.

* * * * *